350-269 SR
9/22/87 XR 4,695,837

United States Patent [19]

Kalt

[11] Patent Number: 4,695,837

[45] Date of Patent: Sep. 22, 1987

[54] ELECTROSTATIC DISPLAY DEVICE WITH IMPROVED FIXED ELECTRODE

[76] Inventor: Charles G. Kalt, 29 Hawthorne Rd., Williamstown, Mass. 01267

[21] Appl. No.: 587,313

[22] Filed: Mar. 7, 1984

Related U.S. Application Data

[63] Continuation-in-part of Ser. No. 299,804, Sep. 8, 1981, Pat. No. 4,468,663.

[51] Int. Cl.[4] ..... G09G 3/16

[52] U.S. Cl. ..... 340/763; 340/764; 340/815.27; 350/269

[58] Field of Search ..... 340/752, 763, 764, 815.27; 350/269; 40/449, 492

[56] References Cited

U.S. PATENT DOCUMENTS

| | | | |
|---|---|---|---|
| 3,304,549 | 2/1967 | Aiken | 340/815.27 |
| 3,460,134 | 6/1967 | Aiken | 340/764 |
| 4,229,075 | 10/1980 | Ueda et al. | 350/269 |

*Primary Examiner*—Gerald L. Brigance
*Assistant Examiner*—Jeffery A. Brier
*Attorney, Agent, or Firm*—Handal & Morofsky

[57] ABSTRACT

An electrostatic display device of the type which includes a fixed electrode (16) of first reflective properties and a movable flapper (30) of different reflective properties has an improved fixed electrode. In particular, the fixed electrode (16) includes structure for defining venting regions or passages (44) which allow air from the atmosphere to communicate with the underside of a mechanical flapper (30) in the display device.

16 Claims, 10 Drawing Figures

ELECTROSTATIC DISPLAY DEVICE WITH IMPROVED FIXED ELECTRODE

CROSS REFERENCE TO RELATED PATENT APPLICATION

This application is a continuation in part of an earlier filed application of the inventor herein entitled Electromechanical Reflective Display Device filed Sept. 8, 1981 under Ser. No. 299,804, now U.S. Pat. No. 4,468,663.

TECHNICAL FIELD

The present invention relates to display devices of the type incorporating a conductive flapper which is mechanically moved from one position to another in order to change the reflective characteristics of a display element.

BACKGROUND ART

Mechanical display devices of the type which include a flapper or flag which is moved in order to change the reflective properties of a cell are well known in the art. The method of moving the flapper may comprise magnetic means, electromagnetic means, electrostatic means, or the like. One such system is described in my earlier co-pending application referred to above.

In electrostatic systems of this kind, a fixed electrode which is made of a conductive material covered with an insulative material having one color is sequentially exposed and covered by a Mylar flapper having or giving reflective properties different from the insulative material. Movement of the Mylar flapper is achieved through the use of electrostatic forces.

One of the problems with such prior art systems is the time needed to move a flapper from one position to another. Generally, in order for a system to be desirable, the amount of power necessary to cause the desired movement must be small. If electrical drive is used, the amount of voltage is the limiting factor. In particular, it is desirable to have as low a driving voltage as possible in order to minimize the voltage in the system which may typically include very low voltage devices such as integrated circuits and the like.

Typically, the flapper in an electrostatic display device is made of double metallized Mylar, which is a brand of plastic film, having a thickness typically on the order of 0.0025 cm. with two millionths of a centimeter of aluminum coated onto both sides of the plastic film. As a consequence of the thinness of the film, the pneumatic forces that are exerted by air on the flapper as it moves away from the contact with a fixed electrode are significant. In principal, as the flapper is pulled away from the fixed electrode, a vacuum is created behind the fixed electrode into which air must flow. Because of the viscosity of the air, the vacuum remains for a limited period of time during which the pressure of air on the other side of the flapper bearing against the flapper impedes the movement of the flapper, which is desirably subjected to very low voltages and, accordingly, very low attractive electrostatic forces.

DISCLOSURE OF INVENTION

The invention, as claimed, is intended to provide a remedy. It solves the problem of providing an electrostatic display device in which pneumatic forces are largely neutralized. The same is achieved in the instant invention by providing passages which allow atmospheric pressure to be exerted upon both sides of the flapper in an electrostatic display pixel.

BRIEF DESCRIPTION OF DRAWINGS

Several ways of carrying out the invention are described in detail below with reference to the drawings which illustrate only several specific embodiments, in which.

BEST MODE FOR CARRYING OUT THE INVENTION

Figure 1:
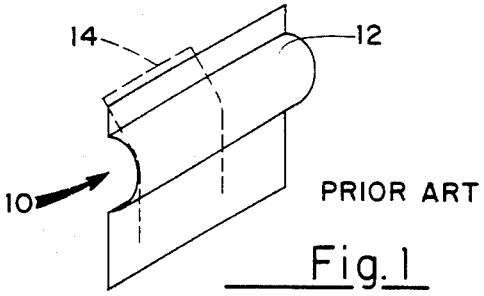
FIG. 1 is a schematic perspective view of a prior art electrostatic display device.

A prior art electrostatic display device 10 is illustrated in FIG. 1. Device 10 comprises a fixed electrode 12 and a flapper 14. Generally, fixed electrode 12 comprises a conductive metal, such as brass, which is coated with an insulative pait. Flapper 14 is made of Mylar having a thickness on the order of 0.025 mm. The Mylar plastic is, in turn, coated on both sides about two millionths of a centimeter of aluminum in order to give it a conductive surface. By varying the voltage between the fixed electrode 12 and flapper 14, the position of flapper 14 may be varied from the position shown in FIG. 1, where the flapper is in contact with the fixed electrode to a position where it is repelled from the fixed electrode and, for example, may extend vertically, thereby exposing the color of the fixed electrode to view. The display characteristics are achieved by having different reflective characteristics on the flapper and the fixed electrode, thus resulting in a change of reflectivity upon actuation and displacement of the flapper.

Figure 2:
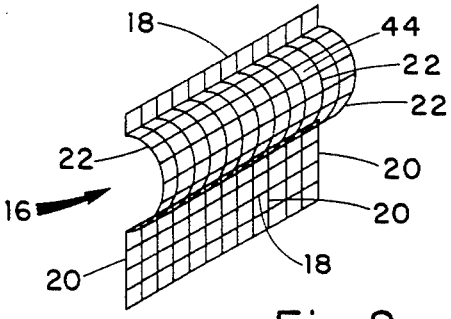
FIG. 2 is a schematic perspective view of a fixed electrode constructed in accordance with the present invention.

As is discussed above, the use of the fixed electrode such as that in FIG. 1 in combination with a very thin plastic film flapper results in significant pneumatic forces which work against the operation of the device. In order to solve this problem a fixed electrode such as that illustrated in FIG. 2 is provided. The inventive fixed electrode 16 generally comprises a similarly shaped fixed electrode configuration which is made by a plurality of conductive wires which include horizontal elements 18 and vertical elements 20 such as woven screen. The device also comprises a number of curved vertical elements 22.

Figure 3:
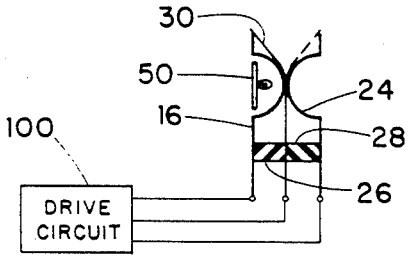
FIG. 3 is a side view of the apparatus of FIG. 2.

The operation of an electrostatic display device such as that illustrated in FIG. 2 may be seen with reference to FIG. 3. In particular, the device illustrated in FIG. 3 includes the fixed electrode 16 illustrated in FIG. 2 and a similar fixed electrode 24. Fixed electrodes 16 and 24 are supported by support blocks 26 and 28 which also support a flapper 30. Flapper 30, fixed electrode 16 and fixed electrode 24 are electrically connected to a drive circuit 100 which applies voltages to them in order to actuate them. For example, if fixed electrode 16 is given a positive potential and fixed electrode 24 is given a negative potential and flapper 30 is given a negative potential the flapper will assume the position illustrated in FIG. 3 in solid lines. If, on the other hand, the voltages of the fixed electrodes 16 and 24 are reversed, the flapper will assume the position illustrated in phantom lines in FIG. 3.

In accordance with the present invention, because the facing areas between the fixed electrode and the flapper during movement of the flapper are minimal due to the fact that the fixed electrode is composed of a wire mesh, pneumatic forces are minimized and operation of the flapper at lower voltages is achievable. In particular, the spaces in the wire mesh allow atmospheric pressure to enter and bear against both sides of the flapper thus promoting the facile movement of the flapper from one electrode to another. In the case of the preferred embodiment where the flapper is made of double-metallized plastic film, the movement from one position to the other position may be dramatically detected if fixed electrodes 16 and 24 are painted different colors and the metallized plastic flapper acts as a mirror reflecting the color of the exposed fixed electrode. Thus if fixed electrode 16 is painted red and fixed electrode 24 is painted black the device will appear black in the position illustrated in solid lines in FIG. 3 while it will appear red in the position illustrated in phantom lines in FIG. 3. In p[articular, the mirror like surface of the flapper will reflect the color of the eposed fixed electrode. Enhanced visibility can be obtained by adding a back reflective member or a light-emitting member 50.

Figure 4:
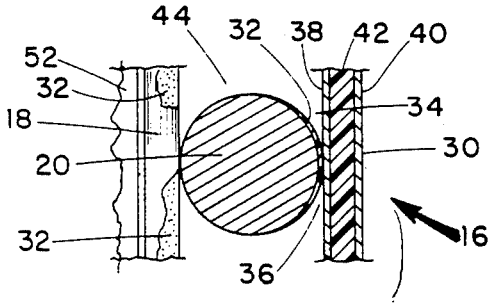
FIG. 4 is a detailed cross-sectional view of a part of the apparatus of FIG. 2.

Referring to FIG. 4, some understanding of operation of the device may be obtained. In particular, the device includes a horizontal wire 18 which underlies a vertical wire 20. Vertical wire 20 may have a conventional round cross-section and is sprayed after assembly thus accumulating a coat of insulative paint 32. Likewise, insulative paint also falls upon the horizontal wire 18. If a reflective member is used it should be of the same color as the insulative paints.

In principle, the operation of the inventive device can be understood by considering portions of the vertical elements 20 of the fixed electrode 16 to be comprised of several areas. Referring to FIG. 4, a first region 34 serves to support flapper 30. Immediately outside region 34 are a pair of electrostatic attractive regions 36 which serve to attract the aluminum layers 38 and 40 which are adhered to the Mylar plastic sheet 42. In addition, devices such as those illustrated in FIGS. 2–6 have the added advantage of having a very low capacitance. This results in decreased time for charging the device and, accordingly, reduces the response time of the device. Finally, the fixed electrode includes open or venting regions 44 through which air passes to the flapper. In principle, the support region may be minimized by using a different cross-section for the wire of the vertical elements 20.

Figure 5:
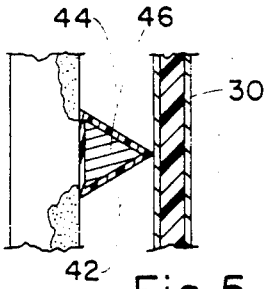
FIG. 5 is a view similar to FIG. 4 of an alternative embodiment of the invention.

For example, a triangular cross-sectional vertical wire 46 may be used as is illustrated in FIG. 5. If a different ratio of support regional area to attractive regional area is desired, a truncated triangular cross-sectional wire 48 can be employed as is illustrated in FIG. 6.

Figure 6:
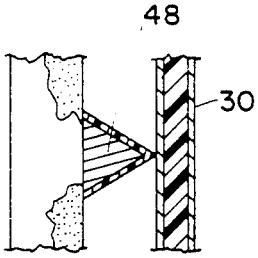
FIG. 6 is a view similar to FIG. 4 of another embodiment of the present invention.

Naturally, the embodiments illustrated in FIGS. 4, 5 and 6 do not have the reflective characteristics of the fixed electrode illustrated in FIG. 1. This can be compensated for in a number of ways. For example, it is possible to put a light source within or behind the fixed electrode. Such a light source 50 is illustrated in FIG. 3. As an alternative, a backing reflective member 52 may be positioned behind the wire mesh as illustrated in FIG. 4. This reflective member 52 may be made of any suitable material, such as paper, plastic or the like.

Figure 7:
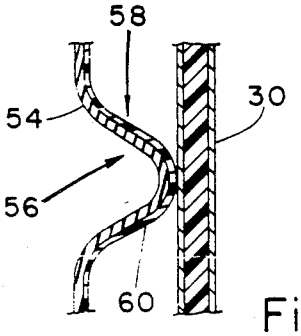
FIG. 7 is a view similar to FIG. 4 of still another alternative embodiment of the present invention.

Still another approach to implementing the inventive system is to repalce the fixed electrode illustrated in FIG. 2 with an electrode made of sheet metal 54 as illustrated in FIG. 7. However, the electrode 56 illustrated in FIG. 7 is not smooth like the electrode 10 illustrated in FIG. 1. In particular, it includes a plurality of vertically disposed ridges 58, which generally follow the paths indicated by the vertical wires 20 in FIG. 2, to which they correspond in function by providing support and venting areas. This type of ridged metal electrode is also coated with a layer of paint 60 as illustrated in FIG. 7.

Figure 8:
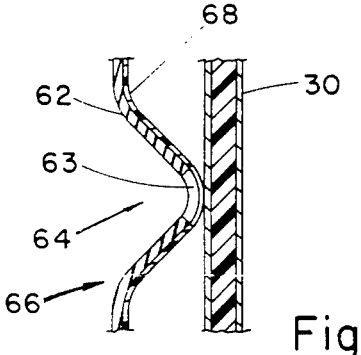
FIG. 8 is a view similar to FIG. 4 of yet another alternative embodiment of the present invention.

Another approach to the problem of providing a venting space is shown in FIG. 8 where a planar metallic member 62 is perforated at region 64 to provide air passages 63 for preventing pneumatic sticking between the flapper 30 and the electrode. The electrode 66 of FIG. 8 is also provided with a reflective insulative paint layer 68. Naturally, the problems of putting a reflective surface or a light source behind the electrode which are necessary with the embodiments of FIG. 2 and FIGS. 5 and 6 are not required with the embodiments of FIGS. 7 and 8 which may be painted in a conventional manner in much the same manner as a prior art electrode such as that illustrated in FIG. 1.

Figure 9:
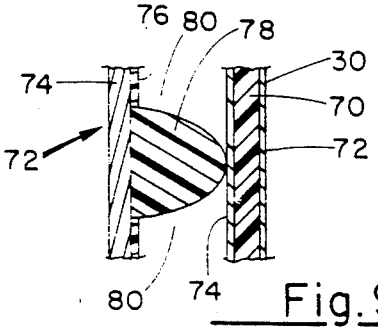
FIG. 9 is a view similar to FIG. 4 of yet still another alternative embodiment of the present invention.

Still yet another approach which preserves the general optical structure of the prior art while providing the desired air passages is illustrated in FIG. 9. In accordance with this embodiment, the flapper 30 made of Mylar plastic 70 and metallized layers 72 and 74 bears against a fixed electrode 72 which includes a metallic layer 74 and an insulative reflective paint 76. The support for the flapper 30 is provided by a ridge of plastic 78 which is adhered to the fixed electrode. The ridge 78 may be made the same color as paint 76. Pneumatic venting spaces 80 are provided adjacent the ridge 78. As noted above, the structure of FIG. 9 may be used without the necessity of a reflective backing member or light source in much the same manner as a prior art device.

Figure 10:
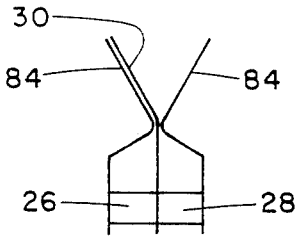
FIG. 10 is a view similar to FIG. 3 of a pixel constructed in accordance with the present invention showing a different profile shape for the fixed electrode.

As can be seen in FIG. 10, the inventive system may be implemented in a plurality of different fixed electrode configurations. For example, the electrodes may take the relatively straight configuration of fixed electrodes 84 illustrated in FIG. 10.

Other modifications may be made to the invention without departing from the spirit and scope of the invention which is limited and defined only by the appended claims.

I claim:

1. An electrostatic display device, comprising:

(a) conductive flexible movable flapper means;

(b) first support means for supporting said movable flapper means at a bending point at one end of said flapper means and with an opposite end of said flapper means as a free end;

(c) a conductive fixed electrode element having insulation disposed over one of its faces to define an insulated face;

(d) second support means for supporting said fixed element, said fixed element being supported in a position with said insulated face facing said movable flapper means and where said movable flapper means is capable of being disposed against or spaced from said fixed element, said fixed element including a plurality of raised surfaces disposed over substantially all of its insulated faces to define together with said movable flapper means air passages which communicate between ambient atmospheric pressure and the side of said movable flapper means disposed against said fixed element when said flapper means is disposed against said fixed element; and (e) electrical drive means coupled to said fixed electrode and said flapper means for moving said movable flapper means between a first position where said flapper means bears against and covers said fixed element and a second position where said flapper means exposes said fixed element.

2. An electrostatic display device as in claim 1 wherein said fixed electrode means is made of a conductive material coated with a non-conductive material.

3. An electrostatic display device as in claim 2, wherein said electrical source is a voltage source for generating a field between said flapper means and said electrode element for electrostatically urging said flapper means toward said fixed electrode means.

4. An electrostatic display device as in claim 1 wherein said conductive electrode means comprises a wire mesh.

5. An electrostatic device as in claim 4 wherein said wire mesh is made f wire having a triangular cross-section.

6. An electrostatic display device as in claim 4 wherein said wire mesh is made of a wire having a round cross-section.

7. An electrostatic display device as in claim 4 wherein said wire mesh is made from wire having a truncated triangular cross-section.

8. An electrostatic display device as in claim 1 wherein said fixed electrode means comprises sheet metal covered with a non-conductive paint and indented to provide spaces between said flapper means and said conductive electrode means when said flapper covers said conductive electrode means.

9. An electrostatic display device as in claim 1 wherein said fixed electrode means is indented in the form of ridges which run between said bending point and said free end.

10. An electrostatic display device as in claim 1 wherein said fixed electrode means comprises a perforated sheet.

11. An electrostatic display device as in claim 1 wherein said conductive electrode means comprises a metallic sheet with plastic spacers disposed thereon configured, positioned and dimensioned to separate said conductive electrode means from said flapper means.

12. An electrostatic display device as in claim 1 wherein said flapper means comprises a thin sheet of plastic coated with a conductive material.

13. An electrostatic display device as in claim 12 wherein said conductive material is disposed on both sides of said thin plastic sheet.

14. An electrostatic display device as in claim 1 wherein said fixed electrode means has a cylindrical configuration.

15. An electrostatic display device, comprising:

(a) conductive flexible movable flapper means;

(b) first support means for supporting said movable flapper means at a bending point at one end of said flapper means and with an oppostie end of said flapper means as a free end;

(c) a conductive electrode element having insulation disposed over one of its faces to define an insulated face;

(d) second support means for supporting said fixed element, said fixed element being supported in a position with said insulated face facing said movable flapper means and where said movable flapper means is capable of being disposed against or spaced from said fixed element, said fixed element including a plurality of perforations to define together with said movable flapper means air passages which communicate between ambient atmospheric pressure and the side of said movable flapper means disposed against said fixed element when said flapper means is disposed against said fixed element; and (e) electrical drive means coupled to said fixed electrode and said flapper means for moving said movable flapper means between a first position where said flapper means bears against and covers said fixed element and a second position where said flapper means exposes said fixed element.

16. An electrostatic display device, comprising:

(a) conductive flexible movable flapper means;

(b) first support means for supporting said movable flapper means at a bending point at one end of said flapper means and with an opposite end of said flapper means as a free end;

(c) a conductive electrode element having insulation disposed over one of its faces to define an insulated face;

(d) second support means for supporting said fixed element, said fixed element being supported in a position with said insulated face facing said movable flapper means and where said movable flapper means is capable of being disposed against or spaced from said fixed element, said fixed element including a wire mesh defining raised surfaces extending between said bending point and said free end to define together with said movable flapper means air passages which communicate between ambient atmospheric pressure and the side of said movable flapper means is disposed against said fixed element; and (e) electrical drive means coupled to said fixed electrode and said flapper means for moving said movable flapper means between a first position where said flapper means bears against and covers said fixed element and a second position where said flapper means exposes said fixed element.

* * * * *